US009748034B2

(12) United States Patent
Okada

(10) Patent No.: US 9,748,034 B2
(45) Date of Patent: Aug. 29, 2017

(54) LAMINATED COIL COMPONENT

(71) Applicant: MURATA MANUFACTURING CO., LTD., Kyoto (JP)

(72) Inventor: Yoshiko Okada, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 14/731,172

(22) Filed: Jun. 4, 2015

(65) Prior Publication Data

US 2015/0270056 A1 Sep. 24, 2015

Related U.S. Application Data

(63) Continuation of application No. PCT/JP2013/083186, filed on Dec. 11, 2013.

(30) Foreign Application Priority Data

Dec. 14, 2012 (JP) ..... 2012-273714

(51) Int. Cl.
*H01F 5/00* (2006.01)
*H01F 27/28* (2006.01)
(Continued)

(52) U.S. Cl.
CPC ..... *H01F 27/2804* (2013.01); *H01F 1/01* (2013.01); *H01F 3/14* (2013.01); *H01F 17/0013* (2013.01);
(Continued)

(58) Field of Classification Search
CPC ..... H01F 5/00; H01F 27/28
(Continued)

(56) References Cited

U.S. PATENT DOCUMENTS

2007/0071986 A1 3/2007 Umeda et al.
2007/0182519 A1* 8/2007 Tsuzuki ..... H01F 17/0006 336/200
(Continued)

FOREIGN PATENT DOCUMENTS

CN 101911221 A 12/2010
CN 102792395 A 11/2012
(Continued)

OTHER PUBLICATIONS

An Office Action; "Notice of Reasons for Rejection," issued by the Japanese Patent Office on Apr. 26, 2016, which corresponds to Japanese Patent Application No. 2014-552063 and is related to U.S. Appl. No. 14/731,172; with English language translation.
(Continued)

*Primary Examiner* — Tsz Chan
(74) *Attorney, Agent, or Firm* — Studebaker & Brackett PC

(57) ABSTRACT

A laminated coil component that can use inexpensive copper as an internal conductor, and has excellent direct current superimposition characteristics is provided. In a laminated coil component including: a magnetic section including a ferrite material; a non-magnetic section including a non-magnetic ferrite material; and a coiled conductor section containing copper as a main component embedded inside the magnetic section and the non-magnetic section, the non-magnetic section contains at least Fe, Mn and Zn, and optionally Cu. The non-magnetic section has a Fe content of 40.0 mol % to 48.5 mol % in terms of $Fe_2O_3$, a Mn content of 0.5 mol % to 9 mol % in terms of $Mn_2O_3$ and a Cu content of 8 mol % or less in terms of CuO.

3 Claims, 2 Drawing Sheets

(51) Int. Cl.

| | |
|---|---|
| ***H01F 3/14*** | (2006.01) |
| ***H01F 17/00*** | (2006.01) |
| ***H01F 41/04*** | (2006.01) |
| ***H01F 1/01*** | (2006.01) |
| *H01F 1/36* | (2006.01) |

(52) U.S. Cl.
CPC ..... *H01F 17/0033* (2013.01); *H01F 41/04* (2013.01); *H01F 41/046* (2013.01); *H01F 1/36* (2013.01); *H01F 2027/2809* (2013.01)

(58) Field of Classification Search
USPC ..... 336/200, 232
See application file for complete search history.

(56) References Cited

U.S. PATENT DOCUMENTS

| | | | |
|---|---|---|---|
| 2010/0271163 | A1 | 10/2010 | Nakamura et al. |
| 2012/0326828 | A1 | 12/2012 | Nakamura et al. |

FOREIGN PATENT DOCUMENTS

| | | | | | |
|---|---|---|---|---|---|
| JP | H09-050929 | A | | 2/1997 | |
| JP | 2004-179360 | A | | 6/2004 | |
| JP | 2005-317748 | A | | 11/2005 | |
| JP | 2006-216636 | A | | 8/2006 | |
| JP | 2006216636 | A | * | 8/2006 | |
| JP | 2007-091539 | A | | 4/2007 | |
| JP | WO 2011108701 | A1 | * | 9/2011 | ..... H01F 1/344 |
| JP | 4811465 | B2 | * | 11/2011 | ..... C04B 35/265 |
| KR | 2012-0123540 | A | | 11/2012 | |
| WO | WO2009/087928 | A1 | | 7/2009 | |
| WO | WO2011/108701 | A1 | | 9/2011 | |

OTHER PUBLICATIONS

Written Opinion of the International Searching Authority; PCT/JP2013/083186; Mar. 25, 2014.
International Search Report; PCT/JP2013/083186; Mar. 25, 2014.

* cited by examiner

LAMINATED COIL COMPONENT

CROSS REFERENCE TO RELATED APPLICATIONS

This application claims benefit of priority to Japanese Patent Application No. 2012-273714 filed Dec. 14, 2012, and to International Patent Application No. PCT/JP2013/083186 filed on Dec. 11, 2013, the entire content of each of which is incorporated herein by reference.

TECHNICAL FIELD

The present disclosure relates to a laminated coil component, and more particularly, relates to a laminated coil component comprising a magnetic section, a non-magnetic section and a coiled conductor section containing copper as a main component.

BACKGROUND

When copper is used as an internal conductor of a laminated coil component, it is necessary to co-fire a copper conductor and a ferrite material in a reducing atmosphere so that copper is not oxidized; however, there are problems such as that Fe in the ferrite material is reduced from trivalent to divalent and to decrease a resistivity of the laminated coil component when fired under such condition. Thus, in general, conductors composed mainly of silver have been used. However, it is preferable to use a conductor composed mainly of copper in light of its low resistance and good conductivity, as well as its inexpensiveness compared to silver.

WO 2011/108701 discloses a ceramic electronic component comprising a magnetic section formed from a ferrite material and a conductor section comprising copper as a main component, wherein the magnetic section contains a trivalent Fe and a divalent element(s) comprising at least divalent Ni, and wherein the magnetic section contains Mn in such an amount that a Fe content in terms of $Fe_2O_3$ is 20-48% as a molar ratio and that the ratio of Mn to the sum of Fe and Mn in terms of $Mn_2O_3$ and $Fe_2O_3$ is less than 50% (inclusive of 0%) as a molar ratio. According to WO 2011/108701, such composition can suppress a decrease in a resistivity of the ferrite material even when copper and the ferrite material are co-fired under a reducing atmosphere, and thus, inexpensive copper can be used as an internal conductor.

SUMMARY

Technical Problem

In general, laminated coil components are small in size and light in weight, but have a drawback of the magnetic body being magnetically saturated and the inductance being decreased when a large direct current is applied, i.e., a direct current superimposition characteristics being degraded. The ceramic electronic component (laminated coil component) disclosed in WO 2011/108701 can use copper which is less expensive than silver; however, its property is considered to be insufficient in light of the direct current superimposition characteristics.

It is common to provide a non-magnetic layer to form an open magnetic circuit structure in order to improve the direct current superimposition characteristics. It is necessary to fire a magnetic layer, the non-magnetic layer and a conductor layer simultaneously in order to form such structure. However, when copper is used in the internal conductor, firing of the conventional non-magnetic material in a reducing atmosphere results in a decrease in resistivity of the non-magnetic layer, and thus, there are problems such as that growth of a plating occurs on this non-magnetic layer when external electrodes are subjected to an electrolytic plating.

Thus, it was difficult to use inexpensive copper as the internal conductor while providing the non-magnetic layer to improve direct current superimposition characteristics in the laminated coil components.

An object of the present disclosure is to provide a laminated coil component that can use inexpensive copper as the internal conductor, and has excellent direct current superimposition characteristics.

Solution to Problem

The present inventor intensively studied solving the above-mentioned problem, and as a result, the present inventor has found that a non-magnetic section of a laminated coil component having a Fe content of 40.0 mol % to 48.5 mol % in terms of $Fe_2O_3$, a Mn content of 0.5 mol % to 9 mol % in terms of $Mn_2O_3$ and a Cu content of 0 mol % to 8 mol % in terms of CuO can suppress the decrease in resistivity of the non-magnetic section even when using copper as an internal conductor and fired under a reducing atmosphere, and can improve the direct current superimposition characteristics of the laminated coil component, and thus, the present inventor has come up with the present disclosure.

According to a first aspect of the present disclosure, there is provided a laminated coil component comprising:

a magnetic section comprising a ferrite material;

a non-magnetic section comprising a non-magnetic ferrite material; and a coiled conductor section embedded inside the magnetic section and the non-magnetic section, wherein the conductor section comprises a conductor containing copper, wherein the non-magnetic section contains at least Fe, Mn and Zn, and may further contain Cu, and wherein the non-magnetic section has a Fe content of 40.0 mol % to 48.5 mol % in terms of $Fe_2O_3$, a Mn content of 0.5 mol % to 9 mol % in terms of $Mn_2O_3$ and a Cu content of 8 mol % or less in terms of CuO.

According to a second aspect of the present disclosure, there is provided a method for manufacturing a laminated coil component comprising:

a magnetic section comprising a ferrite material;

a non-magnetic section comprising a non-magnetic ferrite material; and a coiled conductor section containing copper, the coiled conductor section being embedded inside the magnetic section and the non-magnetic section, the method comprising:

properly stacking a non-magnetic layer formed from the non-magnetic ferrite material having a Fe content of 40.0 mol % to 48.5 mol % in terms of $Fe_2O_3$, a Mn content of 0.5 mol % to 9 mol % in terms of $Mn_2O_3$ and a Cu content of 8 mol % or less in terms of CuO; a magnetic layer formed from the ferrite material; and a conductor layer containing copper to obtain a laminated body comprising the coiled conductor section containing copper embedded therein, and subjecting the obtained laminated body to a heat treatment in an atmosphere with a pressure of an equilibrium oxygen partial pressure of Cu—$Cu_2O$ or less to fire the laminated body.

In the present disclosure, the non-magnetic section comprising the non-magnetic ferrite material means a section comprising a ferrite material that does not substantially exhibit spontaneous magnetization at an operating temperature.

Advantageous Effects of Disclosure

According to the present disclosure, the non-magnetic section of the laminated coil component having the Fe content of 40.0 mol % to 48.5 mol % in terms of $Fe_2O_3$, the Mn content of 0.5 mol % to 9 mol % in terms of $Mn_2O_3$ and the Cu content of 0 mol % to 8 mol % in terms of CuO can suppress a decrease in resistivity of the non-magnetic section, even when fired under a reducing atmosphere, and thus, a laminated coil component which can use inexpensive copper as the internal conductor and has excellent direct current superimposition characteristics is provided.

DETAILED DESCRIPTION

Figure 1:
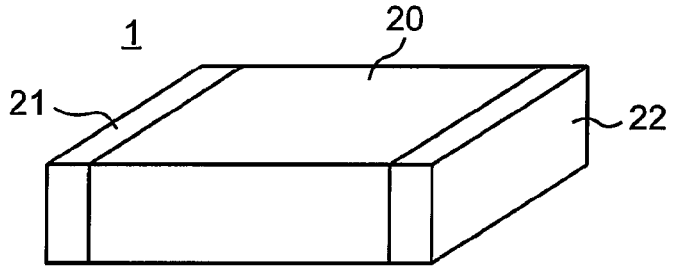
FIG. 1 shows a schematic perspective view of a laminated coil component according to an embodiment of the present disclosure.

A laminated coil component and a method for manufacturing it according to the present disclosure will be described below in detail with reference to the drawings. However, it is to be noted that the laminated coil component according to the present disclosure is not limited to the examples shown in the drawings in terms of configuration, shape, number of turns, arrangement and the like.

Figure 2:
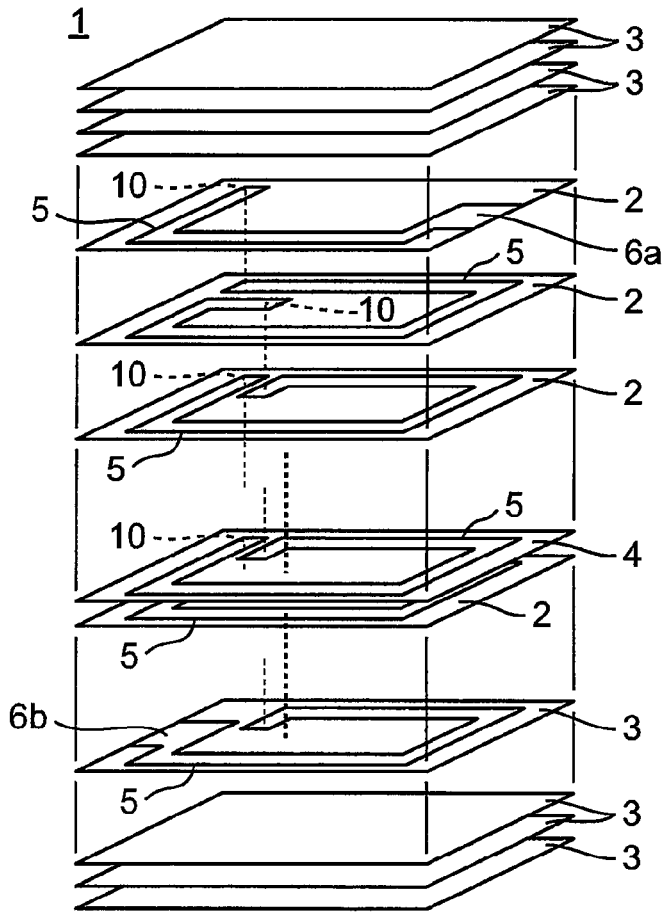
FIG. 2 shows a schematic exploded perspective view of the laminated coil component according to the embodiment in FIG. 1, with external electrodes omitted.
Figure 3:
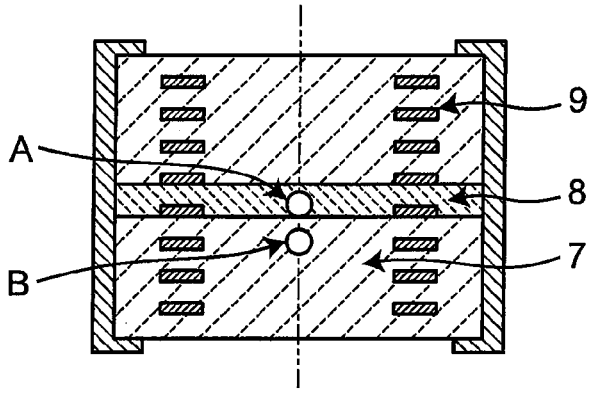
FIG. 3 shows a schematic cross-sectional view of the laminated coil component according to the embodiment in FIG. 1.

As shown in FIGS. 1 to 3, a laminated coil component 1 according to the present embodiment schematically comprises a laminated body 20 comprising a magnetic section 7, a non-magnetic section 8 and a coiled conductor section 9 embedded inside the magnetic section 7 and the non-magnetic section 8, the magnetic section 7, the non-magnetic section 8 and the coiled conductor section 9 being respectively formed by staking magnetic layers 2 (and magnetic layers 3 that are outer layers), a non-magnetic layer 4 and conductor layers 5 in a predetermined order. External electrodes 21 and 22 may be provided so as to cover both outer end surfaces of the laminated body 20, and the external electrodes 21 and 22 may be connected to extraction sections **6*b* and 6*a* located at both ends of the coiled conductor section 9**, respectively.

More specifically, in the present embodiment, the magnetic layers 2 and the non-magnetic layer 4 have a via hole 10 penetrating therethrough, and are stacked to form the magnetic section 7 and the non-magnetic section 8, respectively. Furthermore, conductor layers 5 are respectively arranged between each of the magnetic layers 2 and the non-magnetic layer 4, and these conductor layers 5 are interconnected in a coiled shape through the via holes 10 to form the conductor section 9. The non-magnetic section 8 is arranged at substantially a center of the laminated body 20 so as to cross a magnetic path caused by the conductor section 9.

The magnetic section 7 may comprise a sintered ferrite containing at least Fe, Mn, Ni, Zn and Cu. The non-magnetic section 8 may comprise a sintered ferrite containing at least Fe, Mn and Zn. The conductor section 9 comprises a conductor containing copper as a main component, preferably a conductor substantially consisting of copper, and for example, a conductor having a Copper content of 98.0 to 99.5 wt %. The external electrodes 21 and 22 are not particularly limited, but generally comprise a conductor containing silver as a main component, and nickel and/or tin and the like may be plated thereon.

The above-mentioned laminated coil component 1 according to the present embodiment is manufactured in the following manner.

First, magnetic sheets are prepared. The magnetic sheets are prepared from a magnetic ferrite material containing, for example, Fe, Mn, Ni and Zn, and optionally further Cu.

The magnetic ferrite material contains Fe, Mn, Ni and Zn, and optionally further Cu as main components, and may further contain additional components as necessary. Generally, the magnetic ferrite material may be prepared by mixing and calcining powders of $Fe_2O_3$, $Mn_2O_3$, NiO and ZnO, and optionally further CuO as raw materials in desired proportions; however, the method for preparing the magnetic ferrite material is not limited to the above-mentioned method.

Preferably, the magnetic ferrite material has the Fe content (in terms of $Fe_2O_3$) of 25 mol % to 47 mol % (based on the sum of the main components, the same applies hereinafter) and the Mn content (in terms of $Mn_2O_3$) of 1 mol % to less than 7.5 mol % (based on the sum of the main components, the same applies hereinafter), or has the Fe content (in terms of $Fe_2O_3$) of 35 mol % to 45 mol % and the Mn content (in terms of $Mn_2O_3$) of 7.5 mol % to 10 mol %. Reduction of Fe during sintering of the ferrite material can be efficiently avoided by coexistence of Fe with Mn and the selection of ranges of the Fe content (in terms of $Fe_2O_3$) and the Mn content (in terms of $Mn_2O_3$) in combination with each other as described above, since Mn is preferentially reduced compared to Fe. And thus, it is possible to prevent a decrease in resistivity of the magnetic section due to the reduction of Fe, even when the firing is performed at an oxygen partial pressure of the equilibrium oxygen partial pressure of Cu—$Cu_2O$ or less (reducing atmosphere).

The Zn content (in terms of ZnO) in the magnetic ferrite material is preferably 6 to 33 mol % (based on the sum of the main components, the same applies hereinafter). With the Zn content (in terms of ZnO) of 6 mol % or more, high magnetic permeability, for example, a magnetic permeability of 35 or more can be obtained, and thus, larger inductance can be obtained. In addition, with the Zn content (in terms of ZnO) of 33 mol % or less, a Curie point of, for example, 130° C. or more can be obtained, and thus, a high coil operating temperature can be ensured.

The magnetic ferrite material may further contain Cu as a main component. The Cu content (in terms of CuO) in the magnetic ferrite material may be preferably 5 mol % or less (based on the sum of the main components, the same applies hereinafter), and more preferably 0.2 to 5 mol %. Thus, with the Cu content (in terms of CuO) as low as 5 mol % or less, reduction resistance during sintering of the ferrite material is increased, and thus, the decrease in resistivity of the magnetic section due to the reduction of $Cu^{2+}$ to $Cu^{+}$ can be suppressed within an acceptable range even when the firing is performed at an oxygen partial pressure of the equilibrium oxygen partial pressure of Cu—$Cu_2O$ or less (reducing atmosphere). In addition, with the Cu content (in terms of CuO) of 0.2 mol % or more, sufficient sinterability can be obtained.

The Ni content (in terms of NiO) in the magnetic ferrite material is not particularly limited, but may be the rest excluding Fe, Mn, Cu, Zn, and Cu if present as the other main components described above.

The additive components in the magnetic ferrite material include, but not limited to, for example, Bi, Sn, Co and the like. The Bi content (additive amount) is preferably 0.1 to 1 parts by weight in terms of $Bi_2O_3$ based on 100 parts by weight of the sum of Fe (in terms of $Fe_2O_3$), Mn (in terms of $Mn_2O_3$), Zn (in terms of ZnO), Ni (in terms of NiO) and Cu (in terms of CuO) as the main components. The Bi content (in terms of $Bi_2O_3$) of 0.1 to 1 parts by weight further accelerates low-temperature firing, and can avoid abnormal grain growth. The excessively high Bi content (in terms of $Bi_2O_3$) is not preferable since it is likely to cause abnormal grain growth, decreases the resistivity at the abnormal grain growth site, and causes the abnormal grain growth site to be plated during plating processing in the formation of the external electrodes. Also, the Sn content (additive amount) is preferably 0.3 to 1.0 parts by weight in terms of $SnO_2$ based on 100 parts by weight of the main components. The Sn content in the above-mentioned range can further improve direct current superimposition characteristics. Furthermore, the Co content is preferably 0.1 to 0.8 parts by weight in terms of $Co_3O_4$. The Co content in the above-mentioned range can increase Q at higher frequencies.

The magnetic ferrite material prepared in the above-mentioned manner is used to prepare magnetic sheets. For example, the magnetic sheets may be obtained in such a way that the ferrite material is mixed/kneaded with an organic vehicle containing a binder resin and an organic solvent, and formed into the shape of sheets; however, the method for obtaining the magnetic sheets is not limited to the above-mentioned method.

Then, a non-magnetic sheet is prepared. The non-magnetic sheet is made from a non-magnetic ferrite material containing at least Fe, Mn and Zn, and optionally further Cu. The non-magnetic ferrite material does not contain Ni.

This non-magnetic ferrite material contains Fe, Mn and Zn, and optionally further Cu as main components. Generally, the non-magnetic ferrite material may be prepared by mixing and calcining powders of $Fe_2O_3$, $Mn_2O_3$ and ZnO, and optionally further CuO as raw materials in desired proportions; however, the method for preparing the non-magnetic ferrite material is not limited to the above-mentioned method.

The Mn content (in terms of $Mn_2O_3$) in the non-magnetic ferrite material may be 0.5 to 9 mol % (based on the sum of the main components, the same applies hereinafter). The Mn content (in terms of $Mn_2O_3$) of 9 mol % or less can suppress the generation of the heterogeneous phase during firing under a reducing atmosphere, and thus, it can avoid conversion into magnetic material. Furthermore, the Mn content (in terms of $Mn_2O_3$) of 0.5 mol % or more can suppress the reduction of Fe, and suppress the decrease in resistivity of the non-magnetic section.

The Fe content (in terms of $Fe_2O_3$) in the non-magnetic ferrite material is not particularly limited, but may be 40.0 to 48.5 mol % (based on the sum of the main components, the same applies hereinafter). The Fe content (in terms of $Fe_2O_3$) of 48.5 mol % or less can suppress the reduction of Fe from trivalent to divalent, and suppress the decrease in resistivity. In addition, when the Fe content (in terms of $Fe_2O_3$) is less than 40 mol % with the Mn content being increased, the non-magnetic ferrite material exhibits magnetic property at room temperature.

Also, the sum of the Fe content (in terms of $Fe_2O_3$) and the Mn content (in terms of $Mn_2O_3$) in the ferrite material in the above-mentioned magnetic sheet is preferably comparable in amount to the sum of the Fe content (in terms of $Fe_2O_3$) and the Mn content (in terms of $Mn_2O_3$) in the non-magnetic ferrite material. When the sum of the Fe content (in terms of $Fe_2O_3$) and the Mn content (in terms of $Mn_2O_3$) in the ferrite material is the same as those in the non-magnetic ferrite material, the difference in sintering behavior between the magnetic sheet and the non-magnetic sheet can be reduced, and defects such as cracks can be suppressed.

The non-magnetic ferrite material may further contain Cu as a main component. Generally, Cu is added to the non-magnetic ferrite material in such a manner that CuO powder as a raw material is mixed and calcined with the other main components in desired proportion. The Cu content (in terms of CuO) in the non-magnetic ferrite material is preferably 8 mol % or less (based on the sum of the main components, the same applies hereinafter), and more preferably, may be 0.1 to 8 mol %. The Cu content (in terms of CuO) of 8 mol % or less can suppress the generation of the heterogeneous phase (CuO phase) and suppress the decrease in resistivity of the non-magnetic section. In addition, the Cu content (in terms of CuO) of 0.1 mol % or more can accomplish higher sinterability.

The Zn content (in terms of ZnO) in the non-magnetic ferrite material is not particularly limited, but may be the rest excluding Fe, Mn, and Cu if present as the other main component as described above.

The non-magnetic ferrite material prepared in the above-mentioned manner is used to prepare the non-magnetic sheet. For example, the non-magnetic sheet may be obtained in such a way that the non-magnetic ferrite material is mixed/kneaded with an organic vehicle containing a binder resin and an organic solvent, and formed into the shape of a sheet; however, the method for obtaining the non-magnetic sheet is not limited to the above-mentioned method.

Separately, a conductor paste is prepared. Commercially available common copper pastes containing copper in powder form can be used.

Then, as shown in FIG. 2, the above-mentioned magnetic sheets (corresponding to the magnetic layers 2) and the non-magnetic sheet (corresponding to the non-magnetic layer 4) are stacked with the copper-containing conductor paste layers (corresponding to the conductor layers 5) interposed therebetween, the conductor paste layers being interconnected in a coiled shape through via holes (corresponding to the via holes 10) provided to penetrate through the magnetic sheets and the non-magnetic sheet, to obtain a laminated body (corresponding to the laminated body 20, but an unfired laminated body) which has the conductor paste layers sandwiched by magnetic sheets (corresponding to the magnetic layers 3).

The method for forming the above-mentioned laminated body (unfired laminated body) is not particularly limited, and a sheet lamination method, a printing lamination method and the like may be used to form the laminated body. In the case of the sheet lamination method, a laminated body can be obtained by providing the magnetic sheets and the non-magnetic sheet with via holes appropriately, printing the conductor paste in a predetermined pattern (while filling the via holes with the conductor paste when the via holes are provided) to form the conductor paste layers, staking and pressure-bonding the magnetic sheets the non-magnetic sheet with the conductor paste layers being formed thereon appropriately, and cutting the pressure-bonded body into a predetermined size. In the case of the printing lamination method, a laminated body is prepared by repeating appropriately a step of printing a magnetic paste comprising the ferrite material to form a magnetic layer, or a step of printing a non-magnetic paste comprising the non-magnetic ferrite material to form a non-magnetic layer, and a step of printing the conductor paste in a predetermined pattern to form a conductor layer. When forming the magnetic layers and the non-magnetic layer, via holes are provided in predetermined positions so as to provide conduction between the upper and lower conductor layers, and finally, the magnetic paste is printed to form the magnetic layers 3 (corresponding to the outer layers), and then, through cutting into a predetermined size, a laminated body can be obtained. This laminated body may be obtained in such a way that a plurality of laminated bodies are prepared in a matrix at a time, and then cut into individual pieces (subjected to element separation) by dicing or the like for individualization, but may be individually prepared in advance.

Next, the laminated body (unfired laminated body) obtained as described above is subjected to a heat treatment, thereby the magnetic layers, the non-magnetic layer and the conductor layers are fired to be the magnetic section 7, the non-magnetic section 8 and the conductor section 9, respectively, and thus, the laminated body 20 is formed.

The oxygen partial pressure when firing is carried out is preferably an equilibrium oxygen partial pressure of Cu—$Cu_2O$ or less (reducing atmosphere). The heat treatment of the unfired laminated body at such an oxygen partial pressure can avoid Cu in the conductor section from being oxidized. In addition, it is possible to sinter the unfired laminated body at a temperature lower than that in case of the heat treatment in air, and the firing temperature can be 950 to 1050° C. While the present disclosure is not bound by any specific theory, when fired in an atmosphere with low oxygen concentration, oxygen defects are considered to be formed in the crystal structure and thereby to promote interdiffusion of Fe, Mn, Ni, Cu and Zn through such oxygen defects, and make it possible to enhance low-temperature sinterability.

Next, the external electrodes 21 and 22 are formed so as to cover both end surfaces of the laminated body 20 obtained as described above. The external electrodes 21 and 22 can be formed, for example, in such a way that copper powders in the form of a paste with glass and the like are applied to predetermined regions, and the obtained structure is subjected to a heat treatment at a temperature of, for example, 900° C. to bake the copper, and then, Ni plating and Sn plating are performed in this order. The external electrodes 21 and 22 are connected to extraction sections **6*b* and 6*a* located at both ends of the conductor section 9**, respectively.

In this way, the laminated coil component 1 according to the present embodiment is manufactured.

The Fe content in the non-magnetic section of the above-mentioned laminated coil component is 40.0 to 48.5 mol % in terms of $Fe_2O_3$, and the Mn content is 0.5 to 9 mol % in terms of $Mn_2O_3$. Such a non-magnetic section can suppress the decrease in resistivity even when fired under a reducing atmosphere, whereby it becomes possible to use inexpensive copper as the inner conductor, and to improve the direct current superimposition characteristics.

The content of each of the main components in the magnetic section and the non-magnetic section is evaluated in the following manner. That is, a plurality (e.g. 10 or more) of the laminated coil components are encased in resin so as to present the end surfaces, polished along the length direction of the samples to obtain polished cross-sections at a position of about ½ in the length direction, and the polished cross-sections are cleaned. The content of each component can be evaluated by performing a quantitative analysis of each component with the use of wavelength-dispersive X-ray spectroscopy (WDX method) at a substantially central position (region A in FIG. 3) for the non-magnetic section, and at a position (region B in FIG. 3) in the region within the coil and near the central axis of the coil and at least 100 μm apart from the non-magnetic layer for the magnetic section, respectively, and by calculating averages of the measurement results for the plurality of the samples. The measurement area can differ depending on the analytical instrument used, and for example, the measurement area is, but not limited to, several tens nm to 1 μm in measurement beam diameter.

The Fe content (in terms of $Fe_2O_3$), the Mn content (in terms of $Mn_2O_3$), the Cu content (in terms of CuO), the Zn content (in terms of ZnO) and the Ni content (in terms of NiO) in substantially a center of the magnetic section and the non-magnetic section may be considered to be substantially the same as the Fe content (in terms of $Fe_2O_3$), the Mn content (in terms of $Mn_2O_3$), the Cu content (in terms of CuO), the Zn content (in terms of ZnO) and the Ni content (in terms of NiO) in the ferrite material and the non-magnetic ferrite material before firing, respectively.

In addition, the laminated coil component as described above has a spinel structure in both of the magnetic section and the non-magnetic section, and thus, the occurrence of delamination and cracking during firing due to the difference in thermal expansion coefficient can be suppressed.

While an embodiment of the present disclosure has been described above, various modifications can be made to this embodiment.

In particular, only one layer of the non-magnetic section is placed at substantially a center of the laminated body in the above-mentioned embodiment; however, the present embodiment is not limited to the above-mentioned configuration. The non-magnetic section may be placed at any position as long as it is placed so as to cross the magnetic path caused by the coiled conductor section, and one or more layers of the non-magnetic section may be placed. For example, in the above-mentioned embodiment, the outer layers are the magnetic layers; however, the outer layers may be the non-magnetic layers. Furthermore, the magnetic layers and the non-magnetic layers may be stacked alternately, and the conductive layers may be provided therebetween.

EXAMPLES

Preparation of Magnetic Sheets

In order to obtain a magnetic ferrite material for forming the magnetic layers, $Fe_2O_3$:44.0 mol %, ZnO:26.0 mol %, CuO:1.0 mol %, $Mn_2O_3$:5.0 mol %, NiO:24.0 mol % were weighed to be the above-mentioned ratios. These weighed materials were placed in a pot mill made of vinyl chloride together with pure water and PSZ (Partial Stabilized Zirconia) balls, subjected to wet mixing and grinding for 48 hours, and subjected to evaporative drying, and then, subjected to calcining for 2 hours at a temperature of 750° C.

The calcined powder thus obtained was again put in the pot mill made of vinyl chloride together with ethanol (organic solvent) and PSZ balls, subjected to mixing and grinding for 24 hours, and further mixed with the addition of a polyvinyl butyral-based binder (organic binder) to obtain a ceramic slurry.

Next, a doctor blade method was used to form the ceramic slurry into a sheet such that the thickness of the sheet was 25 μm, and the sheet was subjected to punching into a size of 50 mm vertical and 50 mm horizontal to prepare magnetic sheets.

Preparation of Non-Magnetic Sheets

In order to obtain a ferrite material for forming the non-magnetic layer, powders of $Fe_2O_3$, ZnO, CuO and $Mn_2O_3$ were weighed to be the compositions shown for Sample Nos. 1-19 in Table 1. Sample Nos. 3-8 and 11-17 are Examples of the present disclosure, and Sample Nos. 1-2, 9-10 and 18-19 (denoted by the symbol "*" in the table) are Comparative Examples.

TABLE 1

| Sample | Composition of non-magnetic material (mol %) | | | |
|---|---|---|---|---|
| No. | $Fe_2O_3$ | ZnO | CuO | $Mn_2O_3$ |
| 1* | 49.0 | 50.0 | 1.0 | 0.0 |
| 2* | 48.8 | 50.0 | 1.0 | 0.2 |
| 3 | 48.5 | 50.0 | 1.0 | 0.5 |
| 4 | 48.0 | 50.0 | 1.0 | 1.0 |
| 5 | 46.5 | 50.0 | 1.0 | 2.5 |
| 6 | 44.0 | 50.0 | 1.0 | 5.0 |
| 7 | 41.5 | 50.0 | 1.0 | 7.5 |
| 8 | 40.0 | 50.0 | 1.0 | 9.0 |
| 9* | 39.0 | 50.0 | 1.0 | 10.0 |
| 10* | 29.0 | 50.0 | 1.0 | 20.0 |
| 11 | 44.0 | 51.0 | 0 | 5.0 |
| 12 | 44.0 | 50.75 | 0.25 | 5.0 |
| 13 | 44.0 | 50.5 | 0.5 | 5.0 |
| 14 | 44.0 | 49.0 | 2.0 | 5.0 |
| 15 | 44.0 | 47.0 | 4.0 | 5.0 |
| 16 | 44.0 | 45.0 | 6.0 | 5.0 |
| 17 | 44.0 | 43.0 | 8.0 | 5.0 |
| 18* | 44.0 | 41.0 | 10.0 | 5.0 |
| 19* | 44.0 | 39.0 | 12.0 | 5.0 |

Then, the weighed materials for each of Sample Nos. 1 to 19 were placed in the pot mill made of vinyl chloride together with pure water and PSZ balls in the same manner as described above, subjected to wet mixing and grinding for 48 hours, and subjected to evaporative drying, and then, subjected to calcining for 2 hours at a temperature of 750° C.

The calcined powder thus obtained was again put in the pot mill made of vinyl chloride together with ethanol (organic solvent) and PSZ balls, subjected to mixing and grinding for 24 hours, and further mixed with the addition of a polyvinyl butyral-based binder (organic binder) to obtain a ceramic slurry.

Next, a doctor blade method was used to form the ceramic slurry into a sheet such that the thickness of the sheet was 25 μm, and the sheet was subjected to punching into a size of 50 mm vertical and 50 mm horizontal to prepare non-magnetic sheets.

Preparation of Disk-Shaped Samples and Ring-Shaped Samples

Predetermined number of the non-magnetic sheets prepared as described above was stacked to a thickness of about 0.5 mm, heated to 60° C., and pressurized for 60 seconds at a pressure of 100 MPa for pressure-bonding.

This was subjected to punching with dies into a disk having a diameter of 10 mm, and a ring having an outer diameter of 20 mm and an inner diameter of 12 mm.

The obtained disk-shaped laminated bodies and ring-shaped laminated bodies were heated to 400° C. under an atmosphere which did not oxidize Cu to be decreased sufficiently. Then, the disk-shaped laminated bodies and the ring-shaped laminated bodies described above were put into a firing furnace controlled with a mixed gas of $N_2$—$H_2$—$H_2O$ to have an oxygen partial pressure of an equilibrium oxygen partial pressure of Cu—$Cu_2O$ ($1.8\times10^{-1}$ Pa), and subjected to a firing by increasing the temperature to 950° C., and keeping the temperature for 1 to 5 hours to prepare disk-shaped samples and ring-shaped samples for Sample Nos. 1 to 19.

Preparation of Laminated Coil Component

After a laser processing machine was used to form via holes in predetermined positions of the obtained magnetic sheets and non-magnetic sheets as described above, Cu paste containing Cu powder, varnish and an organic solvent was applied by screen printing onto surfaces of the magnetic sheets and the non-magnetic sheets with the via holes being filled with the Cu paste to form a coil pattern.

Then, the magnetic sheets and the non-magnetic sheets with the coil pattern formed thereon were stacked such that the non-magnetic sheets were placed at substantially the center, and then, sandwiched by the magnetic sheets with no coil pattern formed thereon, and subjected to pressure bonding at a temperature of 60° C. and a pressure of 100 MPa for 1 minute to prepare a pressure-bonded block (see FIG. 2). Then, this pressure-bonded block was cut into a predetermined size to prepare a ceramic laminated body.

Next, the obtained ceramic laminated body was heated to 400° C. in an atmosphere which did not oxidize Cu to be decreased sufficiently. Then, the ceramic laminated body was put into a firing furnace controlled with a mixed gas of $N_2$—$H_2$—$H_2O$ to have an oxygen partial pressure of an equilibrium oxygen partial pressure of Cu—$Cu_2O$ ($1.8\times10^{-1}$ Pa), and subjected to a firing by increasing the temperature to 950° C., and keeping the temperature for 1 to 5 hours to prepare a component base (laminated body).

Then, a conductive paste for external electrodes containing Cu powder, glass frit, varnish and an organic solvent was prepared. This conductive paste for external electrodes was applied onto both ends of the above-mentioned component base, dried, then baked at 900° C. in an atmosphere which did not oxidize Cu, and furthermore, subjected to Ni plating and Sn plating in this order by electrolytic plating to form external electrodes. Thus, a sample (laminated coil component) as shown in FIG. 1 was obtained.

As described above, samples (laminated coil components) were prepared for Sample Nos. 1 to 19. It is to be noted that each of the samples was 2.0 mm in width, 2.5 mm in length and 0.9 mm in thickness, and the number of turns was 10.5 turns.

Evaluation

Measurement of Resistivity

Ag electrodes were formed on both surfaces of each of 30 disk-shaped samples for each of Sample Nos. 1 to 19 prepared as described above, a direct voltage of 50 V was applied to measure an insulation resistance, and a resistivity (Ω·cm) was calculated from the sample size. For each of the sample numbers, an average of 30 samples was calculated to be a resistivity (Ω·cm). The results were shown in logarithmic notation (Log p) in Table 2.

Measurement of Magnetic Permeability

Each of 10 ring-shaped samples for each of Sample Nos. 1 to 19 prepared as described above was put into a magnetic body measuring jig from Agilent Technologies Inc. (model number: 16454A-s), and an initial magnetic permeability (–) was measured at 1 MHz by use of an impedance analyzer from Agilent Technologies Inc. (model number: E4991A). For each sample number, an average of 10 samples was calculated to be a magnetic permeability (initial magnetic permeability) μ(–). The results were shown in Table 2.

Presence or Absence of Growth of Plating

Appearance of each of 10 samples of the laminated coil components of Sample Nos. 1 to 19 was observed with an optical microscope. For each sample number, a sample was judged as "×" when a generation of plating occurred on an external electrode in any of the samples, and a sample was judged as "○" when a generation of plating was not found. The results were shown in Table 2.

Direct Current Superimposition Characteristics

Figure 4:
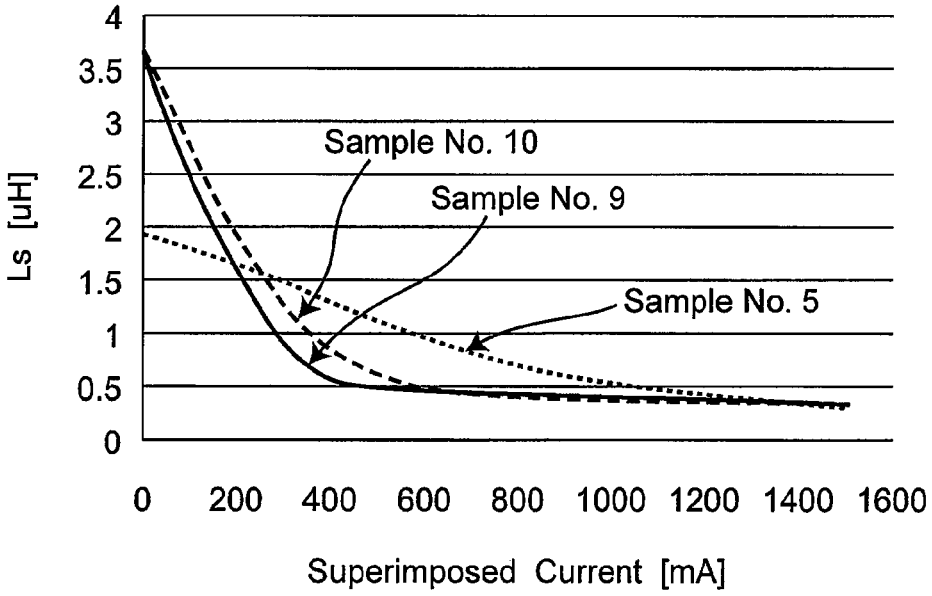
FIG. 4 shows a graph showing the direct current superimposition characteristics of the laminated coil components of Sample Nos. 5, 9 and 10.

For each of 5 samples (laminated coil components) of Sample No. 5, Sample No. 9 and Sample No. 10, a direct-current of 0 to 1,500 mA was superimposed on the samples in conformity with JIS standard (C2560-2) to measure the inductance L at a frequency of 1 MHz. For each sample number, an average of 5 samples was calculated to be an inductance L. The results are shown in FIG. 4.

TABLE 2

| | Evaluation results | | |
|---|---|---|---|
| | Evaluation results for non-magnetic materials | | Evaluation results |
| Sample No. | Magnetic permeability μ (—) | Resistivity Log ρ (Ω · cm) | for laminated coil components Growth of plating |
| 1* | 1 | 2.0 | x |
| 2* | 1 | 3.8 | x |
| 3 | 1 | 4.3 | ○ |
| 4 | 1 | 4.2 | ○ |
| 5 | 1 | 4.4 | ○ |
| 6 | 1 | 4.7 | ○ |
| 7 | 1 | 4.9 | ○ |
| 8 | 1 | 5.0 | ○ |
| 9* | 10 | 5.1 | ○ |
| 10* | 31 | 5.2 | ○ |
| 11 | 1 | 4.2 | ○ |
| 12 | 1 | 4.6 | ○ |
| 13 | 1 | 4.9 | ○ |
| 14 | 1 | 5.0 | ○ |
| 15 | 1 | 4.8 | ○ |
| 16 | 1 | 4.6 | ○ |
| 17 | 1 | 4.2 | ○ |
| 18* | 1 | 3.7 | x |
| 19* | 1 | 3.5 | x |

As is apparent from Table 2, the disk-shaped samples of Sample Nos. 1 and 2 with the Mn content (in terms of $Mn_2O_3$) of less than 0.5 mol % were confirmed to have a low resistivity of Log ρ of less than 4. It is considered that Fe was reduced during firing because of the Mn content being too low, and thereby, the resistivity was decreased. As a result, the growth of plating was confirmed to occur on the non-magnetic section with lower resistivity in the laminated coil components of Sample Nos. 1 and 2.

In addition, the ring-shaped samples of Sample Nos. 9 and 10 with the Mn content (in terms of $Mn_2O_3$) exceeding 9.0 mol % were confirmed to have the magnetic permeability of 10 and 31, respectively, and have magnetic property. As a result, it was confirmed that the laminated coil components of Sample Nos. 9 and 10 could not form an open magnetic circuit structure because of the non-magnetic section having magnetic property, that the inductances of them were greatly decreased when the direct current was superimposed, and that they were inferior in direct current superimposition characteristics as shown in FIG. 4.

In general, the Curie point is considered to be decreased with increasing the Mn content in the sintered ferrite, and as a result, the magnetic permeability of the sintered ferrite is considered to be decreased. However, surprisingly, the magnetic permeability was confirmed from the above-described test results to be increased contrarily when the Mn content (in terms of $Mn_2O_3$) was more than 9.0 mol %.

While the present disclosure is not bound by any specific theory, it is considered that Mn is reduced when the ferrite material is fired in a reducing atmosphere (low oxygen atmosphere); however, when the Mn content (in terms of $Mn_2O_3$) is more than 9.0 mol %, heterogeneous phases such as MnO phase and the different spinel crystal phase are deposited, and the magnetic permeability is increased due to the influence of these heterogeneous phases.

From the above-mentioned matters, it was confirmed that the Mn content (in terms of $Mn_2O_3$) was preferably 0.5 to 9.0 mol % in order to fire the non-magnetic ferrite material in a reducing atmosphere.

Furthermore, for the ring-shaped samples of Sample Nos. 18 and 19 with the Cu content (in terms of CuO) of more than 8.0 mol %, it was confirmed that good sinterability was not obtained and that the resistivity was decreased to be Log ρ of less than 4. As a result, growth of plating was confirmed to occur on the non-magnetic section with lower resistivity in the laminated coil components of Sample Nos. 18 and 19.

While the present disclosure is not bound by any specific theory, it is considered to be because a heterogeneous phase (CuO phase) was generated and the sinterability was decreased when the Cu content (in terms of CuO) was more than 8.0 mol %.

INDUSTRIAL APPLICABILITY

The laminated coil component obtained according to the present disclosure can be widely used for various applications, for example, as inductors and transformers in high-frequency circuits and power circuits.

The invention claimed is:

1. A laminated coil component comprising:

a magnetic section including a ferrite material;

a non-magnetic section including a non-magnetic ferrite material; and a coiled conductor section embedded inside the magnetic section and the non-magnetic section, wherein the conductor section including a conductor containing copper, wherein the non-magnetic section contains at least Fe, Mn and Zn, and further contains Cu, and wherein the non-magnetic section has a Fe content of 40.0 mol % to 46.5 mol % in terms of $Fe_2O_3$, a Mn content of 2.5 mol % to 9 mol % in terms of $Mn_2O_3$ and a Cu content of 0.1 to 6 mol % in terms of CuO.

2. The laminated coil component according to claim 1, wherein the magnetic section contains at least Fe, Mn, Ni and Zn, and further contains Cu, wherein the magnetic section has a Cu content of 5 mol % or less in terms of CuO, and wherein the magnetic section has a Fe content of 25 mol % to 47 mol % in terms of $Fe_2O_3$ and a Mn content of 1 mol % to less than 7.5 mol % in terms of $Mn_2O_3$, or has a Fe content of 35 mol % to 45 mol % in terms of $Fe_2O_3$ and a Mn content of 7.5 mol % to 10 mol % in terms of $Mn_2O_3$.

3. A method for manufacturing a laminated coil component including a magnetic section containing a ferrite material, a non-magnetic section containing a non-magnetic ferrite material, and a coiled conductor section containing copper, the coiled conductor section being embedded inside the magnetic section and the non-magnetic section, the method comprising:

properly stacking a non-magnetic layer formed from the non-magnetic ferrite material having a Fe content of 40.0 mol % to 46.5 mol % in terms of $Fe_2O_3$, a Mn content of 2.5 mol % to 9 mol % in terms of $Mn_2O_3$ and a Cu content of 0.1 to 6 mol % in terms of CuO; a magnetic layer formed from the ferrite material; and a conductor layer containing copper to obtain a laminated body including the coiled conductor section containing copper embedded therein, and subjecting the obtained laminated body to a heat treatment in an atmosphere with a pressure of an equilibrium oxygen partial pressure of Cu—$Cu_2O$ or less to fire the laminated body.

* * * * *